US007463013B2

(12) United States Patent
Plojhar

(10) Patent No.: US 7,463,013 B2
(45) Date of Patent: Dec. 9, 2008

(54) REGULATED CURRENT MIRROR

(75) Inventor: Jan Plojhar, Mokra-Horakov (CS)

(73) Assignee: AMI Semiconductor Belgium BVBA, Oudenaarde (BE)

( * ) Notice: Subject to any disclaimer, the term of this patent is extended or adjusted under 35 U.S.C. 154(b) by 0 days.

(21) Appl. No.: 11/282,573

(22) Filed: Nov. 21, 2005

(65) Prior Publication Data

US 2006/0113982 A1 Jun. 1, 2006

(30) Foreign Application Priority Data

Nov. 22, 2004 (EP) ..... 04078180

(51) Int. Cl.
*G05F 3/16* (2006.01)

(52) U.S. Cl. ..... 323/315; 323/312; 323/313; 323/314; 323/317; 323/311; 327/53; 327/66; 327/132; 327/490; 327/540

(58) Field of Classification Search ..... 323/282, 323/315, 312, 313, 314, 317, 311, 227; 327/53, 327/66, 132, 490, 540, 541, 488, 543, 530, 327/52; 330/257, 288; 363/74
See application file for complete search history.

(56) References Cited

U.S. PATENT DOCUMENTS 5,684,432 A * 11/1997 Embree ..... 330/255
5,825,218 A 10/1998 Colli et al.
6,433,528 B1 8/2002 Bonelli et al.
6,707,286 B1 * 3/2004 Gregoire, Jr. ..... 323/316
2002/0039044 A1 * 4/2002 Kwak et al. ..... 327/540
2005/0253570 A1 * 11/2005 Miller et al. ..... 323/312

OTHER PUBLICATIONS

J. Sarao, An improved regulated cascode current mirror, 2002 Published by Elsevier Science Ltd., Tenichal Note.*

Patent Abstract of Japan, vol. 1997, No. 05, May 30, 1997 & JP 09 006450 A, Fuji Electric Co Ltd, Jan. 10, 1997 (the whole document).

* cited by examiner

*Primary Examiner*—Akm E Ullah
*Assistant Examiner*—Nguyen Tran
(74) *Attorney, Agent, or Firm*—Bacon & Thomas, PLLC

(57) ABSTRACT

A regulated mirror current source circuit has an output transistor, a regulator for controlling the output circuit, and a current mirror having two or more current paths. The first path of the mirror is coupled in series with a current path of the output circuit, and the second path is coupled to the regulator, to provide feedback. The feedback can provide better precision, or reduced component area. The circuit can include cascode transistors, and the regulator can have integral control. The output transistor gate-source voltage is overdriven to reduce "on" resistance of the output transistor. When the output transistor is a high voltage transistor, its area can be reduced without sacrificing compliance.

20 Claims, 3 Drawing Sheets

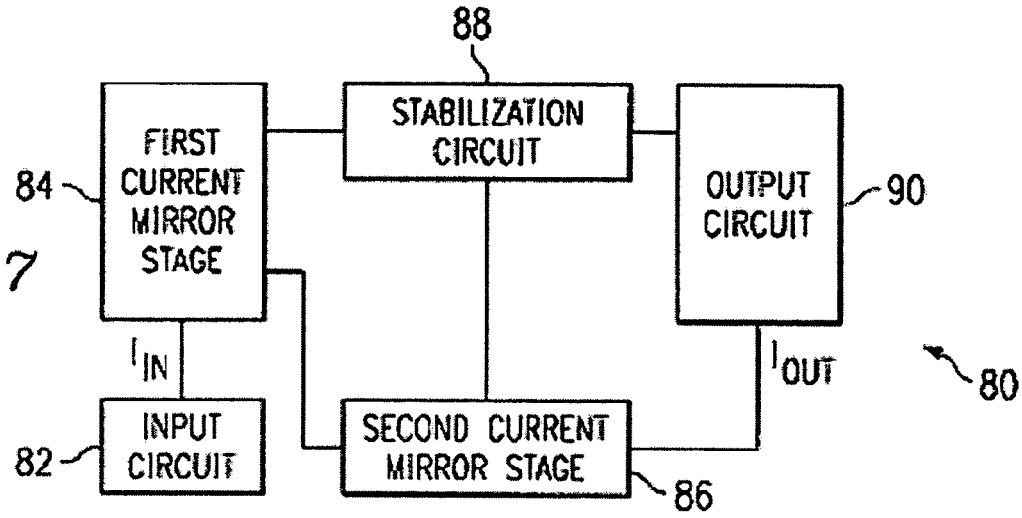
FIG. 1 – PRIOR ART
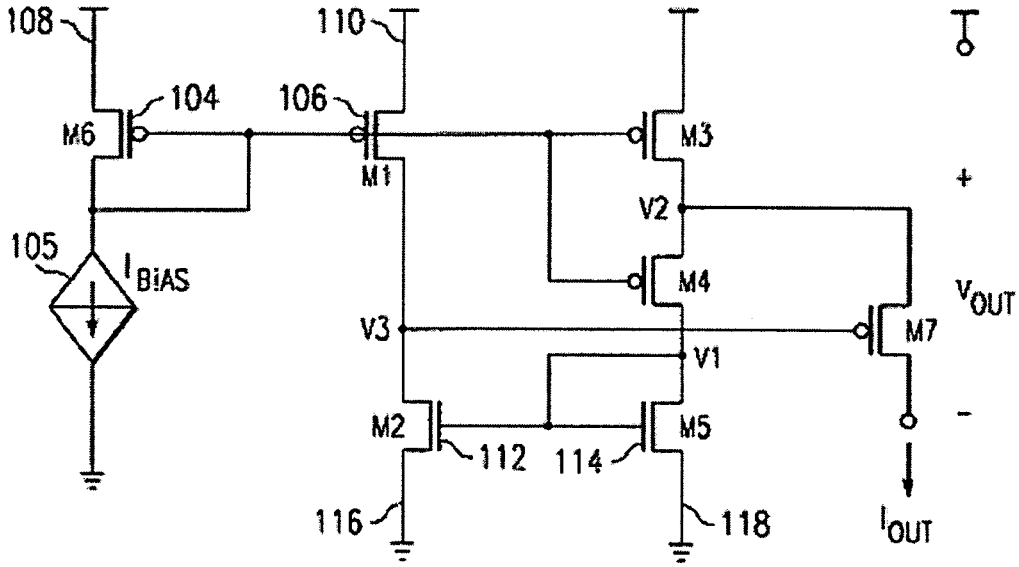
FIG. 2 – PRIOR ART

REGULATED CURRENT MIRROR

FIELD OF THE INVENTION

This invention relates to regulated current mirror circuits and to integrated semiconductor devices having such circuits and methods of making and operating the same.

DESCRIPTION OF THE RELATED ART

It is known to use current mirror circuits for various applications including current sources. These can be used for biasing of differential pairs, or for use in transconductance amplifiers and high speed digital receivers for example. There are many other applications of mirror circuits in analog low voltage or high voltage circuitry. As explained in U.S. Pat. No. 6,433,528, current mirrors replicate at their outputs the currents present at their inputs. There are many variations of the basic current mirror including regular cascode, high-swing cascode, regulated cascode, low voltage current, and active-input regulated cascode mirrors. U.S. Pat. No. 6,433,528 shows in FIG. 6 an example of a regulated cascode current mirror circuit, which uses an operational transconductance amplifier (OTA). A feedback path is provided and the OTA amplifies the difference between the feedback and a reference. Compliance voltage and output resistance are increased due to feedback. The compliance voltage is the output voltage range over which the current can be delivered accurately. But this and other prior art solutions have various disadvantages including lack of headroom, constrained operating characteristics, poor dynamics, and/or the need for OTAs which increase the surface of silicon (or in other words the transistor count) as well as the power dissipation.

To provide a high-impedance current source which has an optimized compliance enhanced operating characteristics and dynamics, and without using OTAs, U.S. Pat. No. 6,433,528 proposes a circuit shown in FIGS. 7 and 8 of U.S. Pat. No. 6,433,528 which uses two stages of current mirrors. As well as first and second current mirror stages, there is a stabilization circuit comprising two transistors coupled between the first and second current mirror stages, and an output circuit fed by the stabilization circuit, between the first and second current mirror stages. An advantage of this circuit is a low compliance voltage or point at which the circuit will operate, due to the feedback operation. This low compliance voltage allows headroom for other circuit operations. U.S. Pat. No. 6,433,528 relies on a regulator with a proportional action. System theory demonstrates that such a regulator used in the considered circuit can never achieve astatism of order 1.

There remains a need for devices with better precision for a given area, or reduced area for a given level of precision, particularly for high voltage applications.

SUMMARY OF THE INVENTION

An object of the invention is to provide improved apparatus or methods for regulated current mirror circuits and integrated semiconductor devices having such circuits and methods of making and operating the same.

The present invention can provide one or more of the following advantages compared with known devices:

a higher output resistance at low frequency, a higher dynamic range at constant compliance and precision, i.e. that the ratio of output current to input current is relatively independent of the operating conditions, the design is not determined by specific properties of the transistors, e.g. the sub-threshold properties of a transistor to sense variations of the output current, a reduction in the number of components, e.g. one current mirror instead of two.

According to a first aspect, the present invention provides a mirror current circuit comprising:

an output circuit including a transistor device to actuate the output current, a regulator for controlling the output circuit, a current mirror having two or more current paths, a first current path being coupled in series with the output circuit, a second current path that provides an image signal representing a feedback signal of the output current, a node for feeding a current error signal to the regulator, said current error signal being generated at said node by subtracting the feedback signal from an input current.

The input current is a set-point signal for the mirror current circuit. The regulator generates a voltage applied to the gate of the transistor device of the output circuit. The regulator has integral action. The transistor device in the output circuit is preferably an MOS transistor.

Compared to known circuits without feedback, the feedback can provide better precision, or reduced component area, i.e. the MOS transistor in the output circuit can be chosen smaller, for a given precision. Compared to known two stage current mirror circuits, which have a feedback mirror circuit, this aspect differs in having the feedback mirror circuit being coupled in series with the output circuit.

An additional feature of the present invention is the current mirror comprising first and second transistors, the first transistor controlling the first current path, the second transistor controlling the second current path, control electrodes, e.g. gates, of the first and second transistors being coupled together. This arrangement enables the current paths to maintain the same or proportional currents. Also, in some embodiments, the second transistor is coupled between a supply line and an input line.

Another such additional feature is the mirror circuit being arranged such that the current in the second path is a proportion of the current in first path. This helps to decrease the total power dissipation.

Another additional feature for a dependent claim is bias current sources being coupled in each of the current paths. These enable the current mirror to be set up appropriately. Another such additional feature is cascode transistors connected in each of the current paths. This can provide a first level of precision for the mirror circuit and hence for the regulation of the output current.

Another such feature is a third transistor coupled to the control electrodes, e.g. gates of the current mirror to set a gate voltage. This can further improve precision.

Another such feature is the circuit being arranged such that in operation the first transistor is maintained close to a boundary between linear operation and saturation, to keep the voltage drop across the first transistor low. This can help optimize the compliance of the current source. This may be achieved by the third transistor and the fourth transistor being coupled in series in the first current path between the cascode transistor and the bias current source.

Another such feature is the third transistor being coupled in the first current path and the control electrodes, e.g. gates, of the current mirror being coupled to the first current path adjacent to the third transistor.

Another such feature is a fourth transistor coupled in the first current path and coupled to the control electrodes, e.g. gates, of the cascode transistors. This can further improve the precision of the current mirror and hence improve the regulation. This is used to determine the best gate voltages for the first and second transistors and the cascode transistors and hence to keep the first transistor at the border between linear operation and saturation.

Another such feature is the regulator having an integral action or control function, i.e. making an integration of a signal over time. This can be implemented by a capacitor. This can provide better regulation.

Another such feature is the output transistor being a MOS device, e.g. a DMOS device. This can enable high voltage operation. High voltage operation includes at least 25, 50, 80 and up to 120V.

Another aspect of the invention provides an integrated circuit having such a current mirror.

The present invention also includes a method of operating a mirror current circuit having a current mirror with two or more current paths, a first current path being coupled in series with an output circuit, the method comprising actuating an output current of the output circuit by means of a transistor device, providing an image signal representing a feedback signal of the output current in a second current path, generating a current error signal at a node by subtracting the feedback signal from an input current and using the current error signal to the regulate the output circuit.

Any of the additional features can be combined together and combined with any of the aspects. Other advantages will be apparent to those skilled in the art, especially over other prior art. Numerous variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which:

FIGS. 1 and 2 show a prior art arrangement

DESCRIPTION OF THE PREFERRED EMBODIMENTS

Figure 3:
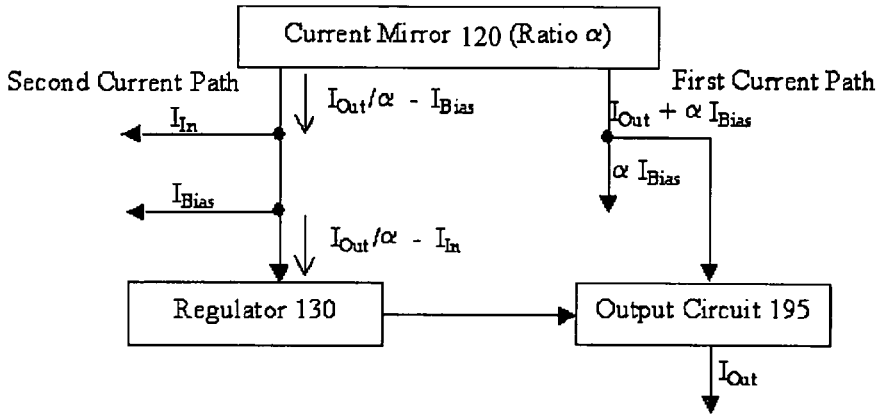
FIGS. 3 and 4 show embodiments of the invention.

The present invention will be described with respect to particular embodiments and with reference to certain drawings but the invention is not limited thereto but only by the claims. Any reference signs in the claims shall not be construed as limiting the scope of the invention. The drawings described are only schematic and are non-limiting. In the drawings, the size of some of the elements may be exaggerated and not drawn on scale for illustrative purposes.

The terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Furthermore, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Moreover, it is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B. Where an indefinite or definite article is used when referring to a singular noun e.g. "a" or "an", "the", this includes a plural of that noun unless something else is specifically stated.

By way of introduction to the embodiments, a known arrangement will be described first, with reference to FIGS. 1 and 2, which are known from U.S. Pat. No. 6,433,528 as discussed above. A current source 80 comprises an input circuit 82, a first current mirror stage 84, a second current mirror stage 86, a stabilization circuit 88, and an output circuit 90. The input circuit 82 provides a biasing current for the current mirror 80. The biasing current for the current mirror 80 may be applied in several ways. The first current mirror stage 84 converts the biasing current to a control voltage, e.g. gate voltage for the stabilization circuit 88 which delivers a fixed current to the output circuit 90. The stabilization circuit 88 offsets variations in the output voltage that in turn cause variations in the regulated output current. The second current mirror stage 86 is interfaced with the first current mirror stage 84 and the stabilization circuit 88 to function as a feedback circuit. The output circuit 90 provides the regulated output current.

An example of how this can be implemented is shown in FIG. 2 wherein seven transistors are used to provide the high-impedance, low-compliance current source. MOS transistors, M6 and M1 form the first current mirror stage. Transistors M6 and M1 have their control electrodes, e.g. gates tied together, and first main electrodes, e.g. sources, connected to a voltage source. The control electrodes, e.g. gates, are tied to the second main electrode, e.g. drain, of transistor M6 and to a bias current source $I_{bias}$. This current source provides the control voltage, e.g. gate voltage for transistor M1. The stabilization circuit comprises MOS transistors M3 and M4. When the control voltage, e.g. gate voltage at M1 is generated, the transistor M1 generates a biasing current for the second current mirror stage, which comprises MOS transistors M2 and M5. Transistors M2 and M5 include control electrodes, e.g. gates, which are tied together and second main electrodes, e.g. drains which are connected to ground. The output circuit comprises a MOS transistor M7.

In operation, the transistor M3 will deliver a fixed current if its second main electrode voltage, e.g. drain voltage, is fixed to a stable value. In this circuit, this second main electrode voltage, e.g. drain voltage, is determined by transistor M4 in sub-threshold mode. By careful design, the saturation of transistor M3 can still be guaranteed even if both transistors M3 and M4 are tied to the same control electrode, e.g. gate. This can be achieved by a high W/L ratio of transistor M4 and setting a very low second main electrode current, e.g. drain current, on transistor M4. If the second main electrode voltage, e.g. drain voltage, of transistor M3 decreases (as a result of an increase in the output voltage $V_{out}$), the current through transistor M4 will diminish. This results in less current through the second current mirror stage comprised of transistors M2 and M5. The decreased current through transistor M2 causes the voltage at node V3 to increase and hence to increase at the control electrode, e.g. gate of output transistor M7 as well. This increase in control electrode voltage, e.g. gate voltage decreases the current flow through transistor M7, thus offsetting the effects of the increased output voltage. Therefore, any change on the second main electrode, e.g. drain, of transistor M3 due to the variation of the output voltage will be offset by operation of the second current mirror stage. Likewise, a decrease in the output voltage will be fed back through the second current mirror stage via transistor M4 and will result in a decreased control electrode voltage, e.g. gate voltage, on transistor M7. The decreased voltage on transistor M7 allows for increased current flow through transistor M7.

Quantitatively, the current is mainly determined by the mirror ratio between MOS transistors M1, M6, and M3. As explained above, the high stability in the output current $I_{out}$ is obtained by tightly controlling the drain voltage of transistor M3, i.e. $V_2$. Deriving a small part of the second main electrode current, e.g. drain current, of transistor M3 in a 1:1 NMOS second current mirror stage, comprised of transistors M5 and M2, provides the tight control of $V_2$.

When the circuit is in balance, the percentage of transistor M3 second main electrode current, e.g. drain current flowing though transistors M4 and M5 is equal to the second main electrode current, e.g. drain current, of transistor M1. To get transistor M3 in saturation mode, this percentage and the size of M4 has to be chosen in such a way transistor M4 operates in the weak inversion region or in sub threshold mode. This means the current ratio between transistors M3 and M1 has to be very high to avoid excessively large dimensions for transistor M4. This scheme will fix the voltage $V_2$ at the beginning of the saturation mode for transistor M3 and it will ensure a current proportional to the aspect ratios in transistors M6, M1, and M3.

FIG. 3 shows a schematic view of a regulated mirror current source circuit according to a first embodiment. An output circuit 195, typically in the form of a transistor 205 is driven by a regulator 130. The regulator is fed by an input current $I_{in}$ and by feedback from a current mirror 120. The current mirror 120 has two current paths, which are arranged such that the current in one mirrors the current in the other path. One of the paths is coupled in series with the current path through the output transistor. This means the other of the paths varies as the output current varies, and so the regulator can compensate, to maintain the output current constant. By having the mirror in the current path of the output circuit, there is no need to provide a separate stabilization circuit as shown in FIGS. 1 and 2, hence the circuit can be simpler. Also, it makes it easier to optimize area and precision of a current mirror type current source. This is particularly useful in CMOS high voltage applications. High voltage operation includes at least 25, 50, 80 and up to 120V.

Other aims for these embodiments include providing a large $V_{GS}$, as large as possible for the output transistor (which has the consequence of decreasing Ron [on resistance] for a given size, or reducing size for a given Ron). The output transistor can be a DMOS transistor. The circuits also use as large a $V_{DS}$ as possible for the main mirror devices (which has the consequence that in saturation, it allows for larger threshold $V_T$ mismatch for a given accuracy or a higher accuracy for a given $V_T$ mismatch) and hence can improve accuracy. The feature of an integral type regulator may be credited for higher accuracy as well (beyond a conventional high precision mirror).

Figure 4:
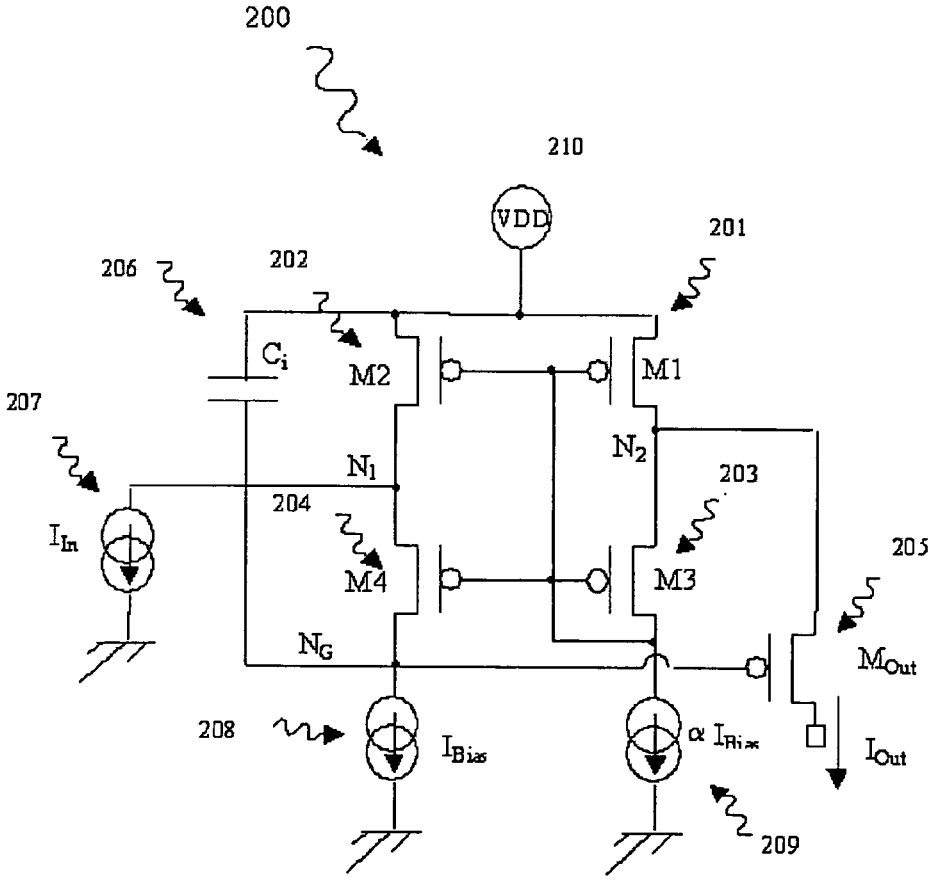

In FIG. 4, a regulated mirror current source 200 has an input or reference current fed from a preceding circuit represented by current source 207. The regulated source comprises a current mirror composed of transistors M1(201) and M2(202), coupled to supply line VDD(210). M2(202) mirrors the current flowing through M1(201) with a ratio a α (alpha). The cascode transistors M3(203) and M2(204) keep the second main electrode voltages, e.g. drain voltages, of transistor M1(201) and M2(202) equal, to provide a first guarantee of precision for the mirror M1/M2.

The current flowing through M1(201) is equal to $I_{Out}+\alpha I_{Bias}$. The current mirrored by M2(202) is equal to $I_{Out}/\alpha+I_{Bias}$. A current subtraction occurs at node N1, and the current $I_{Out}/\alpha-I_{In}$ is integrated by the capacitor $C_i$ (206). In some embodiments of the present invention, the capacitor Ci may be provided by the intrinsic capacitor between the control electrode and the first main electrode, e.g. a gate to source capacitor of output transistor $M_{Out}$ (205).

The voltage at node $N_G$ fed back to the control electrode, e.g. gate, of the transistor $M_{Out}$ will increase or decrease according to the sign of $I_{Out}/\alpha-I_{In}$, and by doing so will adjust the current $I_{Out}$ so as to satisfy the relation $I_{Out}=\alpha I_{In}$.

As discussed above, the regulated mirror current source 200 includes a feedback loop: the output current is fed back by the current mirror M1/M2 and compared to the command signal in the form of input current $I_{In}$. The error signal $I_{In}-I_{Out}/\alpha$ is fed to the input of a regulator. The resulting signal is applied to the gate of transistor $M_{Out}$, effectively closing a control loop. The regulator is effectively implemented by the arrangement of the subtraction of currents at $N_1$ fed by the input current, and feedback current from M2 (202), and fed via cascade transistor M4 (204) to point $N_G$. The regulator optionally includes an integral function, as implemented by the capacitor $C_i$ illustrated.

Figure 5:
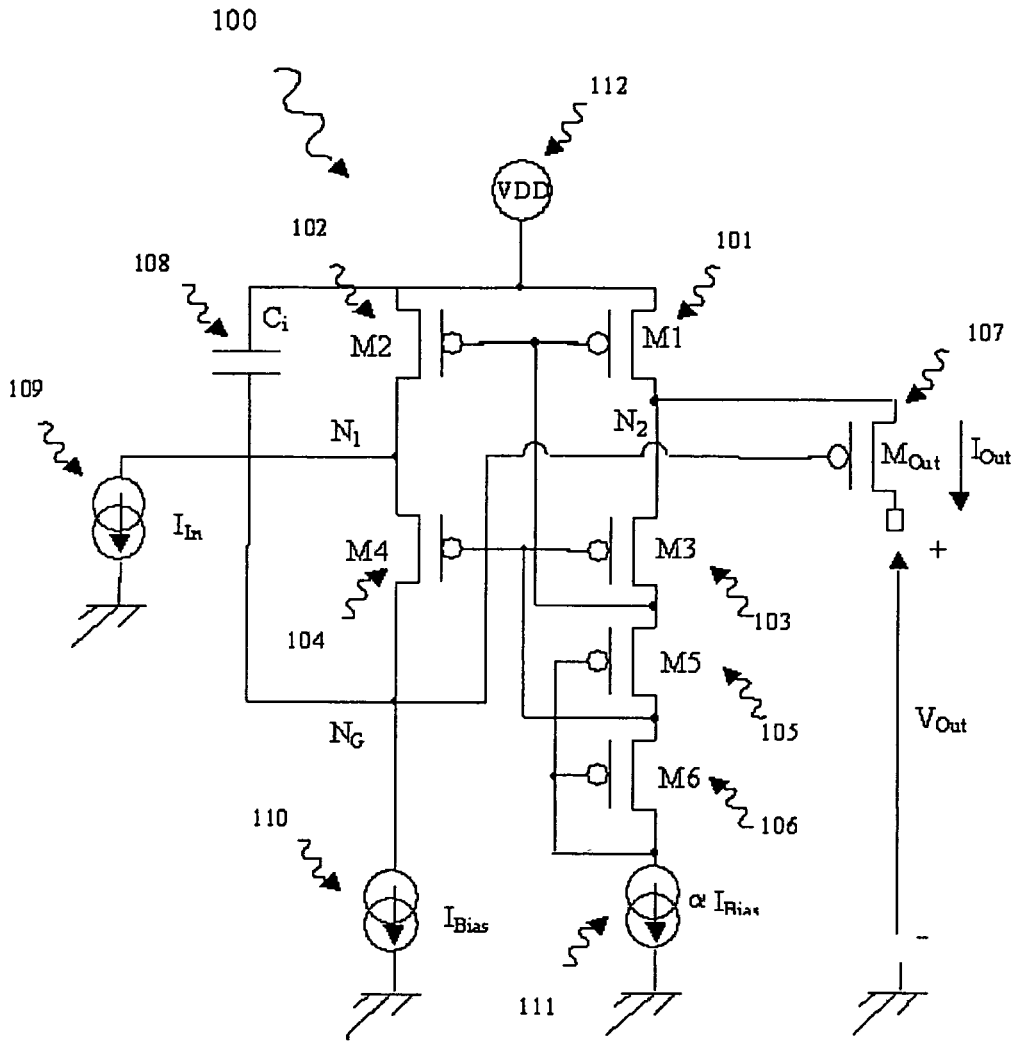
FIG. 5 shows a schematic view of a feedback loop of an embodiment.

FIG. 5 shows another example. Similar to FIG. 4, the regulated mirror current source 100 comprises a current mirror composed of transistors M1(10l) and M2(102), coupled to voltage supply VDD (112). Transistor M2(102) mirrors the current flowing through M1 (101) at a reduced level with a ratio α. The cascode transistors M3 (103) and M4 (104) keep the drain voltages of transistor M1(101) and M2(102) equal, to provide a first guarantee of precision for the mirror M1/M2. A capacitor $C_1$ 108 is provided as in FIG. 4. The output resistor 107 is coupled as before to M1 and has its gate coupled to the regulator output at node $N_G$.

In this case, transistors M5 (105) and M6 (106) are provided in series in the first current path between M3 and the bias current source. They serve to determine the gate voltages of transistors M1/M2 and M3/M4, as the gate of M1/M2 is coupled between M3 and M5 and the gate of M3/M4 is coupled between M5 and M6. This helps ensure that transistor M1(101) will be biased at the boundary between linear operation and saturation, (likewise for M3(103)), keeping the necessary voltage drop across the transistor M1(101) to a minimum and optimizing the compliance of the current source 100. FIG. 4 has a lower transistor count, as it lacks the transistors for maintaining the gate voltages, and in certain cases, its performance may be degraded as a result.

Operation of the circuit of FIG. 4 or 5 can be described by the following equations:

$$ID_1=I_{Out}+\alpha I_{Bias},\ \alpha\epsilon\Re_0^+ \qquad \text{eq (1)}$$

(most of the time $\alpha\epsilon|N_0$)

$\Re_0^+$ is the set of all non zero, positive real numbers $N_0$ is the set of all non-zero natural numbers (in other words non zero, positive integers)

$$ID_2=(I_{Out}+\alpha I_{Bias})/\alpha \quad \text{eq (2)}$$

$$I_{Ci}=sC_i(VDD-V(N_G)) \text{ where s is the Laplace variable}$$

$$I_{Ci}=I_{Bias}-(I_{Out}/\alpha+I_{Bias}-I_{In})=I_{In}-I_{Out}/\alpha$$

$$\Delta V(N_G)=-1/sC_i(I_{In}-I_{Out}/\alpha)$$

$$I_{Out}\approx K'W/L)_{Out}(V(N_2)-V(N_G)-V_{Th})^2$$

W being the width of the transistor, L the length of the transistor and $K'=\frac{1}{2}\mu C_{ox}$ the technological gain of the transistor Hence, $$\Delta I_{Out}\approx -2\,K'W/L)_{Out}(V(N_2)_0-V(N_G)_0-V_{Th})\Delta V(N_G)$$

Or $$\Delta I_{Out}\approx -gm\Delta V(N_G)$$

where gm is the transconductance of the transistor

Using the expression derived for $\Delta V(N_G)$, it follows that:

$$\Delta I_{Out}/gm\approx 1/sC_i(\Delta I_{In}-\Delta I_{Out}/\alpha).$$

Isolating $\Delta I_{Out}$, leads to $$\Delta I_{Out}=gm\alpha\Delta I_{In}/(gm+\alpha C_i s)$$

Figure 6:
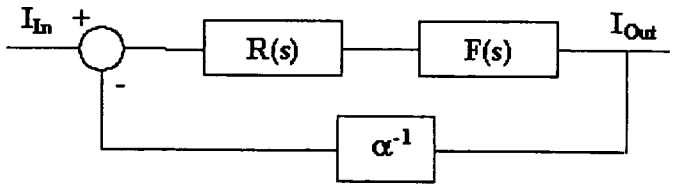
FIG. 6 shows another embodiment.

FIG. 6 shows a schematic view representing the control loop in the arrangement. In this figure, the input is fed to a subtractor for subtracting the feedback "error signal" which is a proportion $\alpha$ of the output current. $\alpha$ is the ratio of the current mirror. The output of the subtractor is passed to a function R(s) representing the transmittance of the regulator, here $R(s)=-1/s\,C_i$. Subsequently the output of that function is fed to function F(s) representing a black box model of the output transistor $M_{Out}$, Since the regulator contains one integration pole, the regulator will, in theory, compensate exactly constant perturbations affecting the system. The output current $I_{out}$ is fed back to the subtractor to form the control loop.

The embodiments of the invention described show at least some of the following advantages:

- for a given compliance, the voltage drop (between VDD, the supply, and the output of the current source) is concentrated over transistor M1.
- the current source is regulated. The present invention includes the use of feedback to provide a higher precision and/or simplicity of the design. In a given embodiment, a regulator with integral action is used.
- the closed loop contains a pole at the origin in the direct chain, and this ensures that "constant" disturbances (variation of Vout among other things) will be perfectly compensated: static gain of the integrator is infinite. That pole is introduced by the capacitor Ci that integrates the error signal and embodies an integral regulator. Circuits of the present invention can achieve astatism of order 1.
- the ON resistance of the output transistor can be minimized by maximizing the gate to source overdrive for that transistor and this while preferably keeping VDS at a minimum for that transistor. Keeping VDS to a minimum improves the output compliance. Maximizing VGS either reduces the RON for given dimensions of the output transistor or allows to decrease the size of that transistor for a given RON compared with known designs.

The voltage drop being concentrated over transistor M1, the VDS of that transistor is maximized for every given output voltage. This allows operation with a gate overdrive as high as possible (while transistor M1 remains in saturation, i.e. $VDS>VGS-V_{Th}$, the gate overdrive), which in turn guarantees the best matching possible in the M1/M2 (fluctuation in $V_{Th}$ will have an impact as low as possible). Indeed, $$\Delta ID=-K'W/L(VGS-V_{Th})\Delta V_{Th}$$

and hence $$\Delta ID/I=-2\Delta V_{Th}/(VGS-V_{Th})$$

which shows that the higher the gate voltage overdrive, the smaller the relative variation of ID will be.

Transistor $M_{Out}$ must not necessarily be in saturation, its VDS may be smaller than $VDS_{Sat}=VGS_{Out}-V_{Th}$ since that transistor is not part of any mirror that requires precision. This means the gate voltage overdrive of the driver transistor can be maximised and guarantees a very low on-resistance. This property makes it possible to optimize either the Ron or the area of the output driver transistor. It also contributes in the optimization of the output compliance.

CONCLUDING REMARKS

Although described for the case of high voltage circuits, using MOS transistors, e.g. DMOS transistors, it is applicable to low voltage circuits. The circuits can be implemented as integrated circuits, as part of much larger systems with many other circuit functions, as modules for application specific circuits, as hybrid circuits, or combinations of discrete components or in other forms for example. Other variations will be apparent to those skilled in the art and are intended to be within the scope of the claims.

The invention claimed is:

1. A mirror current circuit comprising an output circuit including a transistor device to actuate the output current, a regulator for controlling the output current, a current mirror having two or more current paths, a first current path being coupled in series with the output circuit, a second current path that provides an image signal representing a feedback signal of the output current, and a node for feeding a current error signal to the regulator, said current error signal being generated at said node by subtracting the feedback signal from an input current, the input being directly connected to said node.

2. The circuit of claim 1, the current mirror comprising first and second transistors, the first transistor controlling the first current path, the second transistor controlling the second current path, and control electrodes of the first and second transistors being coupled together.

3. The circuit of claim 1, the current mirror being arranged such that the current in the second path is a proportion of the current in the first path.

4. The circuit of claim 1, having bias current sources being coupled in each of the current paths.

5. The circuit of claim 1, having a cascode transistor coupled in each of the current paths.

6. The circuit of claim 4, having a cascode transistor coupled in each of the current paths.

7. The circuit of claim 1, having a third transistor coupled to the control electrodes of transistors of the current mirror, to set a control electrode voltage.

8. The circuit of claim 5, having a third transistor coupled to the control electrodes of transistors of the current mirror, to set a control electrode voltage.

9. The circuit of claim 6, having a third transistor coupled to the control electrodes of transistors of the current mirror, to set a control electrode voltage.

10. The circuit of claim 7, the third transistor being coupled in the first current path, and the control electrodes of the current mirror being coupled to the first current path adjacent to the third transistor.

11. The circuit of claim 8, the third transistor being coupled in the first current path, and the control electrodes of the current mirror being coupled to the first current path adjacent to the third transistor.

12. The circuit of claim 9, the third transistor being coupled in the first current path, and the control electrodes of the current mirror being coupled to the first current path adjacent to the third transistor.

13. The circuit of claim 8, having a fourth transistor coupled in the first current path and coupled to the control electrodes of the cascode transistors.

14. The circuit of claim 11, having a fourth transistor coupled in the first current path and coupled to the control electrodes of the cascode transistors.

15. The circuit of claim 12, having a fourth transistor coupled in the first current path and coupled to the control electrodes of the cascode transistors.

16. The circuit of claim 15, wherein current mirror comprises first and second transistors, the first transistor controlling the first current path, the second transistor controlling the second current path, and control electrodes of the first and second transistors being coupled together, and wherein the third transistor and the fourth transistor are coupled in series in the first current path between the cascode transistor and the bias current source, to keep the voltage drop across the first transistor low.

17. The circuit of claim 1, the regulator having an integral action.

18. The circuit of claim 1, the output circuit comprising a DMOS transistor.

19. An integrated circuit having a regulated mirror current source circuit as set out in claim 1.

20. A method of operating a mirror current circuit having a current mirror with two or more current paths, a first current path being coupled in series with an output circuit, the method comprising:

actuating an output current of the output circuit by means of a transistor device, providing an image signal representing a feedback signal of the output current in a second current path, and generating a current error signal at a node by subtracting the feedback signal from an input current supplied to an input which is directly connected to said node, and using the current error signal to regulate the output circuit.

* * * * *